United States Patent [19]

Shigeta et al.

[11] Patent Number: 4,725,521

[45] Date of Patent: Feb. 16, 1988

[54] CARRIER FOR DEVELOPING ELECTROSTATIC IMAGE

[75] Inventors: Kunio Shigeta; Jiro Takahashi; Kenzi Tsuzita; Hiroyuki Nomori, all of Hachioji, Japan

[73] Assignee: Konishiroku Photo Industry Co., Ltd., Tokyo, Japan

[21] Appl. No.: 910,652

[22] Filed: Sep. 23, 1986

[30] Foreign Application Priority Data

Oct. 4, 1985 [JP] Japan ..... 60-221399

[51] Int. Cl.[4] ..... G03G 9/06

[52] U.S. Cl. ..... 430/108

[58] Field of Search ..... 430/108, 121, 122

[56] References Cited

U.S. PATENT DOCUMENTS 4,272,184 6/1981 Rezanka ..... 430/108

4,297,427 10/1981 Williams et al. ..... 430/108

*Primary Examiner*—John L. Goodrow

*Attorney, Agent, or Firm*—Jordan B. Bierman

[57] ABSTRACT

A carrier for developing electrostatic images is disclosed. The carrier comprises a core and a resin coating layer provided thereon. The coating layer comprises two kinds of polymer resin, one of them is a vinylidene fluoride/tetrafluoroethylene copolymer, and the other one is a polymer containing, as a monomer component, an acrylate which has a group substituted with at least one fluorine atom. The carrier is improved in its durability and electrostatic properties. A high density images without fog are obtained when electrophotographic images are developed with the developer containing this carrier.

5 Claims, No Drawings

CARRIER FOR DEVELOPING ELECTROSTATIC IMAGE

FIELD OF THE INVENTION

The invention relates to a carrier which along with a toner composes an electrostatic image developer, and more specifically relates to a carrier for developing an electrostatic image which enables the presentation of a high-quality image by means of a carrier core coated with a specific resin.

BACKGROUND OF THE INVENTION

In electronic photography, the photosensitive member comprising a photoconductive element is in dark ambience in which an even electrical charge is given on its surface, wherein an electrostatic image is formed by means of an image exposure, and an electrostatic image is developed to produce a visible image.

Generally, the development method for an electrostatic image is roughly classified into the wet development process and the dry development process. The wet development process utilizes in the developing process a liquid developer in which ultra-fine particles of various pigments and colors are dispersed within an electrically insulating organic liquid. The dry development process utilizes the electroscopic fine particles known as toner which are composed of a coloring agent such as carbon black dispersed within a natural or synthetic resin. The dry development process is further categorized into several methods; the so-called fur brush method utilizing a developer composed exclusively of the above toner, the impression method and the powder cloud method. In addition, the so-called magnetic brush method and the cascade method are also available, which employ the developer in the form of a mixture of the carrier made of iron powder or glass beads and the above mentioned toner.

By carrying out such development methodes, the electroscopic particles, for example the electrically charged toner contained within a developer, deposits on the electrostatic image to produce the visible image. Such a visible image, without any change, is fixed on the phtosensitive member by heat, pressure or vapor solvent or, fixed after being transferred onto the paper or another base material.

The present invention relates to the carrier within a developer employed in the above mentioned magnetic brush method as well as the cascade method, and more specifically, relates to the carrier which gives required charge on the toner when it is agitated after being mixed with the toner.

The carrier is generally categorized into the electrically conductive carrier and the electrically insulating carrier.

As the conductive carrier an oxidized or non-oxidized iron powder is generally utilized. However, with the developer composed of an iron powder carrier, the triboelectric charge is not stably provided on the toner, as a further demerit, the visible image formed by the developer may be fogged. That is, in the course of employment of the developer the toner particles will deposit on the surface of the iron powder carrier particles causing a decrease in bias current due to increased electrical resistance on the carrier particles, resulting in a poorer definition and worse fogging of the visible image to be produced. For this reason, when the developer containing the iron powder carrier is employed in an electronic copying machine and if a copying operation is continuously carried out, the developer will deteriorate within a limited number of operational sequences and must be replaced or replenished so as to continuously obtain well-defined images.

With the typical insulating carrier, the surface of the carrier core composed of the ferromagnetic material such as iron, nickel or ferrite is evenly covered with insulating resin. When such an insulating carrier is incorporated into a developer, adhesion of toner particles on the surface of carrier is, unlike the case of the conductive carrier, minimized and at the same time the triboelectric charging between the toner and the carrier may be controlled, giving the developer rather longer service life. It is another advantage that such a developer may be employed in high-speed electronic copying machines. On the other hand with the insulating carrier, the coating covering the surface of the carrier core should be sufficiently friction resistant (durability), the coating should have sufficient adhesion-preventing characteristics so as to prevent the toner from forming a layer on the surface of the toner, in addition, the electrostatic charge with required intensity and polarity due to the friction between the carrier and the specific toner should be produced (electrostatic charge properties).

More precisely, when the insulating carrier within a developing unit is subjected to friction between other carrier particles, toner particles and inner surface of the unit, and the coating is worn due to the fricative movement, the stable electrostatic characteristic which is the product of the friction between the carrier and the toner will be gradually lost and consequently the required electrostatic charge cannot be given to the toner particles. Additionally, even if the coating of the insulating carrier the sufficient wear resistance, and if the adhesion of the coating to the core is improper, the electrostatic charge characteristic will be seriously damaged because the coating will peel off or collapse due to the fricative force mentioned above. Besides this, if the toner sticks to the surface coating to form a film, the result is again an unstable electrostatic characteristic. In such cases, and regardless of reasons, the entire developer should be prematurely replaced with a new developer.

In an effort to solve such drawbacks, the method to cover the surface of the core of the carrier with blended polymer (see Japanese Patent Publication Open to Public Inspection No. 110839/1979; hereinafter referred to as Japanese Patent O.P.I. Publication) is known as well as the carrier in which the surface of the core material is covered with copolymer of vinylidene fluoride/tetrafluoroethylene or covered with such a copolymer along with a second blended polymer. (See Japanese Patent O.P.I. Publication No. 208754/1983, No. 176048/1985, No. 176049/1985, No. 176050/1985, No. 176051/1685, No. 176052/1985, No. 176053/1985, No. 176054/1985, No. 176055/1985.)

Also the carrier using the acrylate having fluorine atoms in a side chain as coating resin was disclosed (see Japanese Patent Examined Publication No. 16617/1985). The applicant, prior to these publications, also proposed a similar art in regard to the like carrier in the specifications attached to Japanese Patent Application No. 240758/1984, No. 240759/1984, No. 240763/1984 and No. 240762/1984.

However, the carrier coated with copolymer of vinylidene fluoride/tetrafluoroethylene has a certain demerit, as the soft resin is responsible for a shorter service life due to the wear and tear of the coating layer.

Additionally, in the carrier coated with a blended polymer composed of the copolymer of vinylidene fluoride/tetrafluoroethylene along with the second polymer, the blended second polymer remarkably improved the bonding between the coating and the core, besides which, the much harder resin itself contributed greatly to a longer service life. However, the blending of the second polymer constituted a drawback; a smaller or unstable electrostatic charge.

With the carrier coated with an acrylate which has fluorine atoms in side chain, the electrostatic charge is defectively insufficient. With the carrier disclosed in Japanese Patent Examined Publication No. 16617/1985, for example, the electrostatic charge was apparently insufficient. Even with the carrier disclosed in the Japanese Patent Application No. 240758/1984 submitted by the said applicant, the electrostatic charge was still insufficient though it was much greater than that of the above mentioned carrier and the electrostatic charge became unsatisfactorily unstable in the course of an extended copying operation.

SUMMARY OF THE INVENTION

The object of the invention is to provide the carrier with excellent durability and electrostatic charge capacity, with minimized fogging and higher image density.

The object of the invention is accomplished by a carrier for developing an electrostatic image having a coating layer comprising a copolymer of vinylidene fluoride/tetrafluoroethylene and a polymer containing, as a monomer component, an acrylate which has a group substituted with at least one fluorine atom as a side chain.

DETAILED DESCRIPTION OF THE INVENTION

The details of the invention are given below.

The desirable copolymer molar ratio for the copolymer of vinylidene fluoride/tetrafluoroethylene contained within the coating layer of the present invention carrier is within the range of 75:25–95:5, and, more preferably, within the range of 75:25–87.5:12.5. If the molar ratio of the copolymer remains within the above specified range, the solubility of a solvent is improved and the layer-forming characteristic and layer strength are also improved, realizing a longer service life. Additionally, it is undesirable that the molecular weight is too great even if the solubility of the solvent is improved, as the viscosity of the solution will become too great and the coating will be uneven, resulting in pinholes and deteriorated durability. On the other hand, the resin of too small molecular weight is also unpreferable, of which poor strength causes problems on the durability of the carrier. For this reason, the intrinsic viscosity (in relation to methyl ethyl ketone, at 30° C.), which is the guide to the molecular weight should preferably remain within the range of 0.1 dl/g–5 dl/g.

With the present invention, as the acrylate, which has a side chain involving fluorine atoms substituent, contained in the coating layer of the carrier, the one composed of a monomer indicated by the following general formula (1) is preferred.

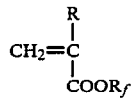

General formula (1)

(In the above formula, R represents a hydrogen atom or a methyl group, $R_f$ represents an alkyl group or an aralkyl group in which at least one fluorine atom has been substituted.)

As the preferred embodiments of the acrylate indicated by the above general formula (1), there are the acrylates defined by the following general formulae (2) and (3).

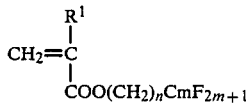

General formula (2)

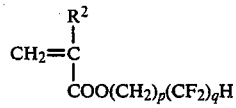

General formula (3)

In the above formulae, $R^1$ and $R^2$ respectively represent a hydrogen atom or a methyl group, n and p respectively represent an integer number 1–8, m and q respectively indicate an integer number 1–19.

Further, the more preferable embodiments of acrylate defined by the above general formula (2) and (3), there are those given by the following general formulae (4) and (5).

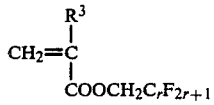

General formula (4)

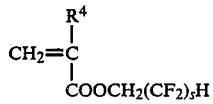

General formula (5)

In the above formulae, $R^3$ and $R^4$ represent a hydrogen atom or a methyl group, r indicates 1 or 2, s denotes an integer 2 through 4.

The embodiments of the acrylate, employed in the present invention, which have, in the side chain, at least one fluorine atom as a substituent are, for example:

1,1-dihydroperfluoroethyl acrylate (methacrylate),
1,1-dihydroperfluoro-n-propyl acrylate (methacrylate),
1,1,3-trihydroperfluoro-n-propyl acrylate (methacrylate),
1,1,4-trihydroperfluoro-n-butyl acrylate (methacrylate),
1,1,5-trihydroperfluoro-n-amyl acrylate (methacrylate).

With the present invention, the monomer component employed in the polymer contained in the coating layer (hereinafter called the polymer employed in the present invention) along with the copolymer of vinylidene fluoride/tetrafluoroethylene may solely consist of the acrylate containing at least one fluorine atom in the side chain a substituent or, involve another component. As examples of such a component there are acrylic (methacrylic) acid, methyl acrylate (methacrylate), ethyl acrylate (methacrylate), butyl acrylate (methacrylate), benzyl acrylate (methacrylate), amide acrylate (methacrylate), cyclohexyl acrylate (methacrylate), glycidyl acrylate (methacrylate), hydroxyethyl acrylate (methacrylate), styrene, vinyl acetate, ethylene, propylene and isoprene.

The following are several embodiments of the polymers utilized in the present invention, however, this does not necessarily mean that these are all the possible embodiments. [Examples of chemical compounds]

Polymer (1)

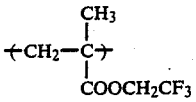

Polymer (2)

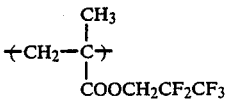

Polymer (3)

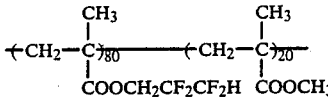

Polymer (4)

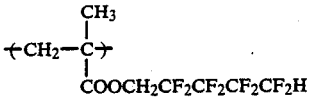

Polymer (5)

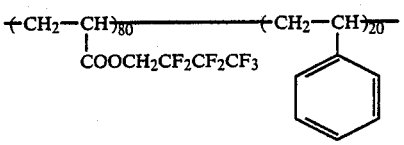

Polymer (6)

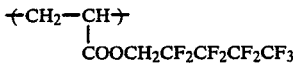

Polymer (7)

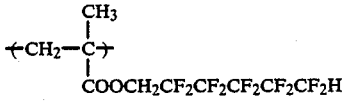

Polymer (8)

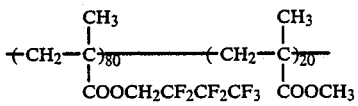

Polymer (9)

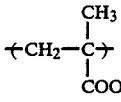

Polymer (10)

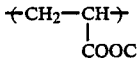

Polymer (11)

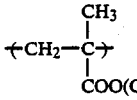

Polymer (12)

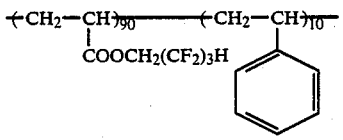

-continued

Polymer (13)

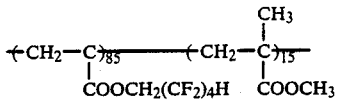

Polymer (14)

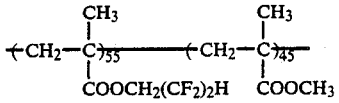

Polymer (15)

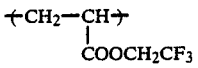

Polymer (16)

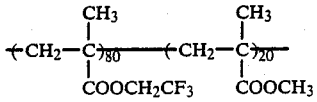

Polymer (17)

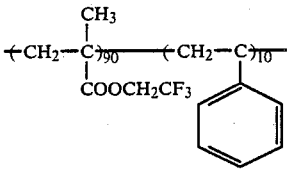

Polymer (18)

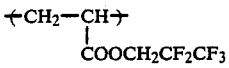

Polymer (19)

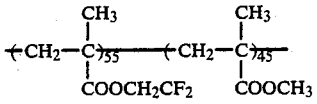

Polymer (20)

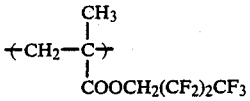

Polymer (21)

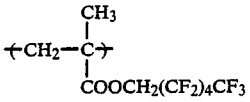

Polymer (22)

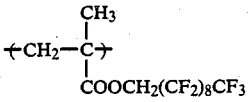

Polymer (23)

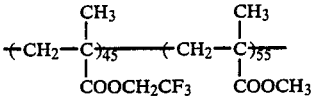

Polymer (24)

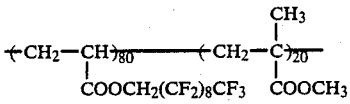

The blending ratio of polymers used in the present invention is, for the copolymer of vinylidene fluoride/-tetrafluoroethylene, 50–95 weight %, preferably 70–95 weight %, and, for the polymer including the acrylate monomer having a substituent of at least one fluorine atom in a side chain, 50–5 weight %, preferably 30–5 weight %. If the blending ratio of polymers is more than 70:30, the resin compatibility is improved and the even distribution of electrostatic charge is realized, causing a much greater capacity of a similar charge. If the like ratio is within 95:5, a much harder and more wear-resistant coating layer will be result. This feature is very desirable in view of durability.

The coating layer of the carrier of the present invention contains the polymer composed of the above mentioned blended polymer and, if required, may also include a third component.

With the present invention, in producing the carrier, the above mentioned vinylidene fluoride/tetrafluoroethylene copolymer as well as the acrylate polymer is dissolved into an organic solvent to prepare a coating solution, which is applied on the surface of the carrier core material by means of, for example, a dry spray method so as to form the coating layer. The layer is then heated, or simply left as it is, to make the carrier of the present invention.

More specifically, within a fluidizing bed unit, for example, the carrier core material is raised by means of raising compressed gas flow up to the height where the core material is statically equilibrated, then, the above-described coating solution is sprayed on the said core material before it starts falling. Such spraying process is repeated until the coating layer is satisfactorily composed. Additionally, if there are aggregated carriers, they are sifted out to finally obtain the carrier of the present invention with the required coating thickness.

As an organic solvent employed in the above-mentioned production process any solvent may be arbitrarily selected in so far as it dissolves the resin composed mainly of the copolymer and polymer of the present invention. The typical organic solvents to be used are, ketones including acetone and methyl ethyl ketone, tetrahydrofuran, dioxane, dimethyl sulfoxide and the solvent composed of fluorine and/or other halogen-substituted carbon hydride. Also, the solvent comprising several of the above solvents may be employed.

The range of coating layer thickness is 0.05–20 μm, or, preferably 0.1–2 μm. the thickness of the like layer exceeding 20 μm is undesirable, as the solvent will remain within the coating layer for a prolonged period of time and exert an adverse effect on the electrostatic charge characteristic, and at the same time, the toner will deposit on the surface of the carrier to constitute a layer. The layer with the thickness within 0.05 μm is regarded undesirable, as the electrostatic characteristic is adversely affected due to pinholes and the durability is damaged by frictional force.

As for the materials of the carrier core of the present invention, sand, glass or metals, which have been used for conventional carrier core materials, may also be employed. However, more preferable materials can be listed. They are, in particular; the materials which are strongly magnetized in the axis of and by the magnetic field, such as ferrite and magnetite; metals showing ferromagnetism, such as iron, cobalt and nickel; alloys or chemical compounds containing such metals; alloys, not including ferromagnetic elements, which change to be ferromagnetic after proper heating treatment, such as manganese-copper-aluminum type or manganese-copper-stannum type Heusler alloy and chromium dioxide and others. The range of particle size of the carrier core materials is 30–1000 μm, and more preferably, 50–500 μm. Furthermore, the carrier utilized in the present invention should preferably have the potential to provide, under normal service condition, the charge of 5–40 μC/g in absolute value to the toner used with the carrier.

The carrier of the present invention may compose a two component developer along with a toner which may be arbitrarily selected. As the most desirable toner, one which incorporates a polyester resin or styrene/acrylate resin as a binder should be noted.

Polyester resin is obtained by condensation polymerization between alcohol and carboxylic acid. As for the alcohols to be used, there are, for instances, diols including ethylene glycol, diethylene glycol, triethylene glycol, 1,2-propylene glycol, 1,3-propylene glycol, 1,4-butanediol, neopentylglycol, 1,4-butanediol, 1,4-bis (hydroxymethyl) cyclohexane, etherified bisphenols involving bisphenol A, hydrogenated bisphenol A, polyoxyethylene bisphenol A, polyoxypropylene bisphenol A, and other dihydric alcohol monomers.

Also, as for carboxylic acids, there are, for example, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, and anhydrides of these acids, dimers of lower alkyl ester and linolenic acid, and other bivalent organic acid monomers.

As for the polyesters employed in the present invention, in addition to the above-mentioned bifunctional monomers, the polymers involving components of multifunctional monomers greater than trifunctional monomers are also preferred. For available examples of the polyhydric alcohol monomers, which are the above described multifunctional monomers, having at least 3 hydroxy groups, there are; sorbitol, 1,2,3,6-hexanetetrol, 1,4-sorbitan, pentaerythritol, dipentaerythritol, tripentaerythritol, saccharose, 1,2,4-butanetriol, 1,2,5-pentatriol, glycerol, 2-emethylpropanetriol, 2-methyl-1,2,4-butanetriol, trimethylolethane, trimethylolpropane, 1,3,5-trihydroxymethylbenzene and others.

In addition, examples of the polycarboxylic acid monomers containing at least 3 carboxylic acid groups, those available are; 1,2,4-benzenetricarboxylic acid, 1,3,5-benzenetricarboxylic acid, 1,2,4-cyclohexanetricarboxylic acid, 2,5,7-naphthalanetricarboxylic acid, 1,2,4-naphthalanetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, empoltrimer acid, and the anhydrides of these acids, and so on.

The components of the above mentioned multifunctional monomers should preferably be composed of 20–30 mol % of each alcohol component or acid component which is the structural unit of the polymer.

In a styrene/acrylate resin, the $\alpha,\beta$-unsaturated ethylene monomers, which were disclosed in Japanese Patent O.P.I. Publication No. 134652/1975, are used as the structural unit and, the resins with the ratio of the weight average molecular weight (Mw)/number average molecular weight (Mn) being 3.5–40 may be employed.

The above described polyesters or styrene/acrylic resins should preferably account for 30–95 weight % of the whole toner.

In the preparation of the toner employed in the present invention, coloring agents are added to the above discussed binder, wherein various additional agents are mixed if so required, which are agitated in a ball mill, etc. and are further treated in the processes comprising mixing, grinding and classification to realize the said toner.

Additionally, the said toner may be obtained through such methods as the spray dry method, interfacial polycondensation, suspension polycondensation and solution polycondensation.

The particle size of the toner prepared by the above process methods is 1–50 μm or more preferably 5–30 82 m.

As the embodiments of the coloring agents contained in the toner the following should be notedicarbon black, nigrosine, aniline blue, chalcoil blue, chrome yellow, ultramarine blue, methylene blue, rose bengal, phthalocyanine blue, and the mixture of these agents.

In addition, the above toner may contain the particles of hydrophobic silica or fatty acid metallic salt. Such particles of hydrophobic silica were disclosed in Japanese Patent Examined Publication No. 16219/1979 as well as No. 16220/1979, and as the preferable embodiments, "Aerosil R972" and "Silica D-17", etc. manufactured by Nippon Aerosil Co., Ltd. should be noted. In regard to the fatty acid metallic salts, those available are, for example; the salt of maleic acid with zinc, magnesium or calcium, etc.; stearic acid with zinc, cadmium, barium, lead, ferrum, nickel, cobalt, copper, aluminum, or magnesium, etc.; dibasic lead stearate; oleic acid with zinc, magnesium, ferrum, cobalt, copper, lead or calcium, etc.; palmitic acid with aluminum, or calcium, etc.; lead caprylate; lead caproate; linolic acid with zinc or cobalt, etc.; calcium ricinoleate; ricinoleic acid with zinc or cadmium, etc.; or a mixture of these salts. The salt content against the toner is 0.01–10 weight %. As for the admixture method, the so-called external admixture method is widely practiced.

Further, as an additional agent which is added if required, an offset inhibitor and a charge controlling agent, etc. are available.

The developer is obtained by mixing the above-mentioned carrier of the present invention and the toner. The developer should be preferably comprised of 100 parts of the carrier and 0.3–20 parts of the toner in terms of weight.

According to the present invention, as evidenced by the following embodiments, the carrier featuring better durability and electrostatic capacity can be prepared, and the highly density image with minimized fog may be effectively produced.

EXAMPLES

The examples of the embodiment of the present invention are presented in the following. However, it should be noted that the scope of embodiments of the invention is not limited to these examples.

EXAMPLE 1

Preparation of Carrier and Toner

To begin with, the carriers A–I, the reference carriers A–C and the toners A–C were prepared.

Carrier A 14 g of vinylidene fluoride/tetrafluoroethylene copolymer "VT-100" (copolymer molar ratio 80:20, intrinsic viscosity 0.95 dl/g) (manufactured by Daikin Kogyo Co., Ltd.) as well as 2 g of the polymer indicated by the example polymer (1) (intrinsic viscosity 0.51 dl/g) were dissolved into 500 ml mixed solvent made of acetone and methyl ethyl ketone (1:1) so as to prepare the coating liquid. One kilogram the spherical iron powder "DSP135C" (manufactured by Dowa Iron Powder Co., Ltd.), which is the carrier core material, was coated with this coating solution by means of the fluidizing bed apparatus to obtain carrier A with a coating thickness approximately 2 μm.

Carrier B 12 g of the above vinylidene fluoride/tetrafluoroethylene copolymer "VT-100" as well as 3 g of example polymer (9) (intrinsic viscosity 0.57 dl/g) were employed to prepare the coating solution. Apart from this, the same steps as for carrier A were carried out to prepare the carrier B.

Carrier C 14 g of the above vinylidene fluoride/tetrafluoroethylene copolymer "VT-100" along with 1 g of example polymer (20) (intrinsic viscosity 0.49 dl/g) were employed to prepare the coating solution. Apart from this, the same steps as for carrier A were carried out to prepare the carrier C.

Carrier D 9 g of vinylidene fluoride/tetrafluoroethylene copolymer (intrinsic viscosity 0.86 dl/g), obtained by making vinylidene fluoride react with tetrafluoroethylene at the molar ratio of 75:25, along with 3 g of example polymer (3) (intrinsic viscosity 0.62 dl/g), were utilized. Apart from this the sam steps as for carrier A were exercised to prepare the carrier D.

Carrier E 14 g of vinylidene fluoride/tetrafluoroethylene copolymer (intrinsic viscosity 1.14 dl/g), obtained by making vinylidene fluoride react with tetrafluoroethylene at the molar ratio of 90:10, along with 1 g of example polymer (2) (intrinsic viscosity 0.57 dl/g), were utilized. Apart from this, the same steps as for carrier A were exercised to prepare the carrier E.

Carrier F 8 g of the above vinylidene fluoride/tetrafluoroethylene copolymer "VT-100" and 7 g of example polymer (1) were utilized. Apart from this, the same steps as for carrier A were exercised to prepare the carrier F.

Carrier G

Instead of the "VT-100", the vinylidene fluoride/tetrafluoroethylene copolymer obtained by making vinylidene fluoride react with fluoroethylene at the molar ratio of 70:30 was utilized. Apart from this, the same steps as for carrier A were exercised to prepare the carrier G.

Carrier H 10.5 g of "VT-100" and 4.5 g of example polymer (1) were utilized. Apart from this, the same steps as for carrier A were exercised to prepare the carrier H.

Carrier I 14.2 g of "VT-100" and 0.8 g of example polymer were utilized. Apart from this, the same steps as for carrier A were exercised to prepare the carrier I.

Comparison carrier A 15 g of the vinylidene fluoride/tetrafluoroethylene copolymer "VT-100" was solely utilized and no fluorized acrylate polymer was used. Apart from this, the same steps as for carrier A were exercised to prepare the comparison carrier A.

Comparison carrier B 13 g of the vinylidene fluoride/tetrafluoroethylene copolymer "VT-100" as well as 2 g methyl methacrylate copolymer "Acrypet MF" (manufactured by Mitsubishi Rayon Co., Ltd.) were employed to prepare the coating liquid. Apart from this, the same steps as for carrier A were exercised to prepare the comparison carrier B.

Comparison carrier C 15 g of example polymer (1) was employed. Apart from this, the same steps as for carrier A were exercised to prepare the comparison carrier C.

Toner A 332 g of terephthalic acid, 90 g of polyoxypropylene (2.2)-2,2-bis (4-hydroxyphenol) propane and 587 g of bisphenol A were poured into a round flask which was provided with a thermometer, a stainless steel agitator, a glass tube nitrogen gas inlet as well as a flow-down condenser. The flask was placed on a mantle heater to heat the above three materials in the chemically inert atmosphere provided by introducing nitrogen gas via the nitrogen gas inlet tube. Then, 0.05 g of dibutyltin oxide was added and, while the reaction was monitored at the softening point, the materials were allowed to react at 200° C., whereupon, the polyester was obtained.

In terms of weight, 100 parts of above polyester, 10 parts of carbon black "Regal 660 R" (manufactured by Cabot Co., Ltd.), 2 parts of lower molecular weight polypropylene "Viscol 660P" (manufactured by Sanyo Chemical Industry Co., Ltd.) and 2 parts of ethylenebisstearamide "Hoechst Wax C" (manufactured by Hoechst Japan Ltd.) were mixed by means of a ball mill and, after the process of kneading, grinding and classification, the toner particles with an average particle size 10 μm were obtained, to which hydrophobic silica particles "Aerosil R812" (manufactured by Nippon Aerosil Co., Ltd.) 0.4 weight % as well as zinc stearate 0.1 weight % were added to obtain the toner A.

Toner B

In terms of weight, 100 parts of styrene/methyl methacrylate/n-butyl methacrylate copolymer obtained by reacting together styrene, methyl methacrylate and n-butyl methacrylate at the molar ratio of 50:20:30, 10 parts of carbon black "Regal 660R" (manufactured by Cabot Co., Ltd.) and 3 parts of low-molecular weight polypropylene "Viscol 660P" (manufactured by Sanyo Chemical Industry Co., Ltd.) were mixed by means of a ball mill and, after the processes of kneading, grinding and classification the toner particles with average grain size of 11 μm were obtained, to which 0.5 weight % hydrophobic silica particles "Aerosil R-972" (manufactured by Nippon Aerosil Co., Ltd.) and 0.2 weight % zinc stearate were added to prepare the Toner B.

EXAMPLE 2

As listed in Table 1, the total 11 types of developer, No. 1–11, were provided by combining carrier A–I and toner A–B with 2% concentration which are involved in the present invention.

On the other hand, for comparison purpose, the comparison carrier A–C and toner A with 2% concentration were combined to prepare the total of three types developer, No. 12–14.

Next, by employing the modified version of the electrophotographic copier "U-Bix 4000" (manufactured by Konishiroku Photo Industry Co., Ltd.), which incorporates negative electrostatic dual-layer organic photoconductive photosensitive member containing anthoanthrone type pigment as an carrier generating material and carbazole derivative as a carrier transport material, as many as 100 thousand copies have been continuously produced with each of the developer. The results are present in Table 1.

Additionally, it should be noted that, in the table; "electrostatic charge" means the value of triboelectrostatic charge per every 1 g of toner measured with the known blow-off method; "maximum image density" is indicated by the relative density of the developed image against the image density of the original image which is supposed to be 1.3; "durability" is indicated by the number of the copies produced by the time when fogging occurs and the quality of images is extremely deteriorated, in addition, "peel-off and abrasion of coating" has been evaluated by measuring the coating ratio of the carrier removed from the developing agent which is in use at this point and by comparing this measurement with the coating ratio of the unused carrier. Further, E means no peel off or abrasion of coating, G means within 5% of peel-off or abrasion of coating, N means more than 5% and less than 10% of peel-off or abrasion of coating, L means more than 10% of peel-off abrasion of coating.

Measuring of the coating ratio of the carrier was carried out with the following procedure.

The carrier particles were washed with a surfactant solution to separate from the toner and weighed after drying. The dried carrier particles were treated with the same solvent as used for preparing the resin coating solution to remove the resin coating layer on the carrier particles, and weighed after drying. The coating ratio of the carrier was measured from the decreasing of the weight by removing the coated resin.

TABLE 1

| | Developer No. | Carrier | | | | | |
|---|---|---|---|---|---|---|---|
| | | | | | Exemplified polymer | | |
| | | Name | VdF:TFE Copolymer | Amount added | No. | No. of fluorines | Amount added |
| Invention | 1 | Carrier A | VT-100 (VdF:TFE = 80:20) | 13 g | (1) | 3 | 2 g |
| | 2 | Carrier B | | 12 g | (9) | 4 | 3 g |
| | 3 | Carrier C | | 14 g | (20) | 7 | 1 g |
| | 4 | Carrier D | VdF:TFE = 75:25 | 9 g | (3) | 4 | 3 g |
| | 5 | Carrier E | VdF:TFE = 90:10 | 14 g | (2) | 5 | 1 g |
| | 6 | Carrier F | VT-100 | 8 g | (1) | 3 | 7 g |
| | 7 | Carrier G | VdF:TFE = 70:30 | 13 g | (1) | 3 | 2 g |
| | 8 | Carrier H | VT-100 | 10.5 g | (1) | 3 | 4.5 g |
| | 9 | Carrier I | VT-100 | 14.2 g | (1) | 3 | 0.8 g |

TABLE 1-continued

| | | | | | | | |
|---|---|---|---|---|---|---|---|
| | 10 | Carrier A | VT-100 | 13 g | (1) | 3 | 2 g |
| | 11 | Carrier E | VdF:TFE = 90:10 | 14 g | (2) | 5 | 1 g |
| Comparison | 12 | Comparison carrier A | VT-100 | 15 g | — | — | — |
| | 13 | Comparison carrier B | VT-100 | 13 g | Acrypet MF | — | 2 g |
| | 14 | Comparison carrier C | — | | (1) | 3 | 15 g |

| | Developer No. | Carrier Blend ratio (in wt. %) | Toner | Electrostatic charge (μC/g) | Initial maximum image density | Durability (sheet) | Peeling-off, abrasion |
|---|---|---|---|---|---|---|---|
| Invention | 1 | 87:13 | A | +22.7 | 1.3 | ≧100,000 | E |
| | 2 | 80:20 | A | +21.9 | 1.3 | ≧100,000 | E |
| | 3 | 93:7 | A | +18.3 | 1.4 | 90,000 | G |
| | 4 | 75:25 | A | +19.0 | 1.4 | ≧100,000 | E |
| | 5 | 93:7 | A | +20.6 | 1.3 | ≧100,000 | G |
| | 6 | 53:47 | A | +18.1 | 1.4 | 80,000 | G |
| | 7 | 87:13 | A | +20.1 | 1.4 | 90,000 | E |
| | 8 | 70:30 | A | +19.5 | 1.4 | 95,000 | E |
| | 9 | 95:5 | A | +24.1 | 1.2 | 95,000 | G |
| | 10 | 87:13 | B | +24.5 | 1.2 | ≧100,000 | E |
| | 11 | 93:7 | B | +22.2 | 1.3 | ≧100,000 | G |
| Comparison | 12 | — | A | +25.0 | 1.2 | 35,000 | L |
| | 13 | 87:13 | A | +19.8 | 1.4 | 26,000 | N |
| | 14 | — | A | +15.3 | 1.4 | 31,500 | E |

(Note)
Vdf: Vinylidene fluoride
TFE: Tetrafluoroethylene
Number of fluorines: The number of fluorines in the unit of acrylic acid ester monomer substituted for fluorine atom.

As illustrated by Table 1 in the previous page, the developer involving the present invention carrier features appropriate electrostatic charge characteristic with the toner, besides which, excellent image density and durability, and, little, if any, peel-off or abrasion of the coating takes place.

On the other hand, with the developer involving a comparison carrier, fog or peel-off or abrasion of the coating takes place, and, the durability is extremely limited.

What is claimed is:

1. An electrostatic image developer having a toner and carrier, the carrier having a coating layer comprising a co-polymer of vinylidene fluoride/tetrafluoroethylene and a polymer containing, as a monomer component, an acrylate which has a group substitued with at least one fluorine atom as a side chain, said coatitng layer being from 0.05–20 μm.

2. The developer of claim 1, wherein the molar ratio of vinylidene fluoride and tetrafluoroethylene in said co-polymer is within the range of from 75:25 to 95:5.

3. The developer of claim 1, wherein said acrylate having a group substituted with at least one fluorine atom as a side chain is represented by the general formula (1).

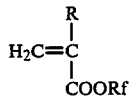

general formula (1)

wherein R represents a hydrogen atom or a methyl group, Rf represents an alkyl group or an aralkyl group substituted with at least one fluorine atom, respectively.

4. The developer of claim 1, wherein said coating layer comprises said vinylidene fluoride/tetrafluoroethylene co-polymer in an amount of from 50 to 95% by weight of said coating layer and said polymer containing said acrylate in an amount of from 50 to 5% by weight.

5. The developer of claim 1, wherein said coating layer comprises said vinylidene fluoride/tetrafluoroethylene co-polymer in an amount of from 70 to 95% by weight of said coating layer and said polymer containing said acrylate in an amount of from 30 to 5% by weight.

* * * * *